United States Patent [19]

Kenny

[11] 3,937,230

[45] Feb. 10, 1976

[54] ELECTRIC HAIRDRESSING IRON

[76] Inventor: James Edward Kenny, 28 Wolvengracht, Brussels, Belgium

[22] Filed: Oct. 4, 1974

[21] Appl. No.: 512,221

[30] Foreign Application Priority Data

July 19, 1974 Belgium ..... 146764

[52] U.S. Cl. ..... 132/37 R

[51] Int. Cl.[2] ..... A45D 2/24

[58] Field of Search..... 132/9, 36 R, 37 R, 9, 111, 132/112, 116, 39; 34/97, 243

[56] References Cited

UNITED STATES PATENTS

| | | | |
|---|---|---|---|
| 1,023,716 | 4/1912 | Brown | 132/37 R |
| 1,473,312 | 11/1923 | Passard | 132/37 R |
| 1,589,183 | 6/1926 | Leunis | 132/39 |
| 1,700,876 | 2/1929 | Blitz | 132/37 R |
| 1,800,271 | 4/1931 | Wehner | 132/36 R |
| 3,126,895 | 3/1964 | Leclabart | 132/36 R |
| 3,520,311 | 7/1970 | Iesersek et al. | 132/111 |

*Primary Examiner*—G. E. McNeill
*Attorney, Agent, or Firm*—Kirschstein, Kirschstein, Ottinger & Frank

[57] ABSTRACT

An hairdressing iron is described comprising a rod, a metal channel coaxial to the rod and attached to the latter in such a way as to swivel in relation to the latter around a transversal axis. The outer surface of the rod presents a longitudinal groove and the iron comprises a second channel adopted to fit longitudinally on the outer surface of the rod, said second channel comprising on its inner surface an elastic component capable of being inserted in the said longitudinal groove in order to retain the second channel on the rod. The outer surface of said second channel may be fitted with one or more rows of teeth projecting from that surface. An articulated U-link may also be provided in such a way as to be swivellable around the transversal swivelling axis for serving as a supporting member when it is in the unfolded position.

5 Claims, 4 Drawing Figures

ELECTRIC HAIRDRESSING IRON

The present invention relates to an electric hairdressing iron permitting not only the waving of the hair but also the combing and smoothing of the hair.

This device comprises a rod and a metal channel coaxial to the rod and attached to the latter in such a way as to swivel in relation to the latter around a transversal axis. The outer surface of the rod presents a longitudinal groove and the iron comprises a second channel adopted to fit longitudinally on the outer surface of the rod, said second channel comprising on its inner surface an elastic component capable of being inserted in the said longitudinal groove in order to retain the second channel on the rod. In a first embodiment, the outer surface of the second channel is smooth, enabling wide waves to be made with this second channel in place and narrower waves, on short hair for instance, with the rod stripped of the second channel. In a second embodiment the outer surface of the second channel is fitted with one or more rows of teeth projecting from said surface.

The invenion will be described more fully below, with reference to the attached drawings.

Figure 1:
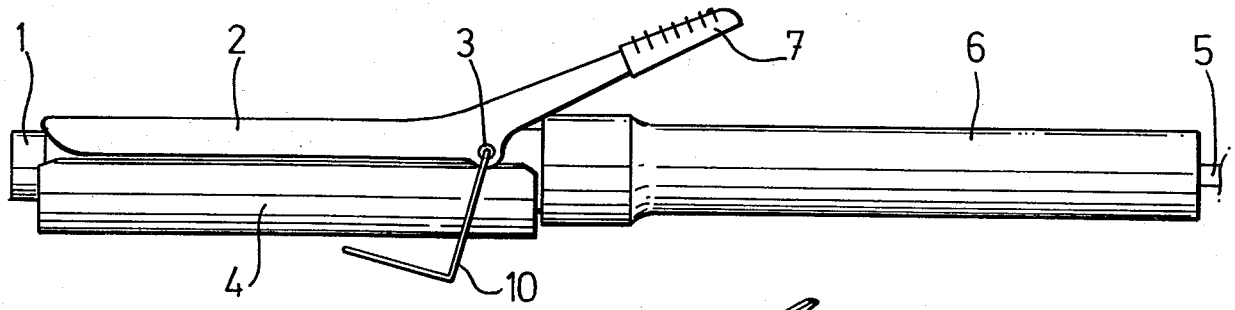
FIG. 1 is a vertical view of the apparatus in a first embodiment.
Figure 2:
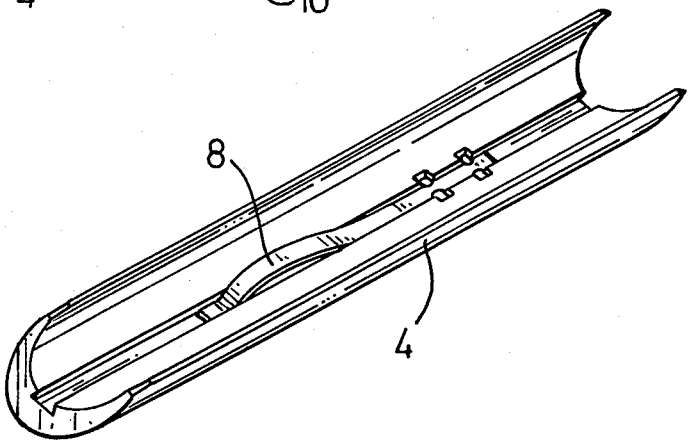
FIG. 2 is a perspective view of the detachable channel, showing its inner surface.
Figure 3:
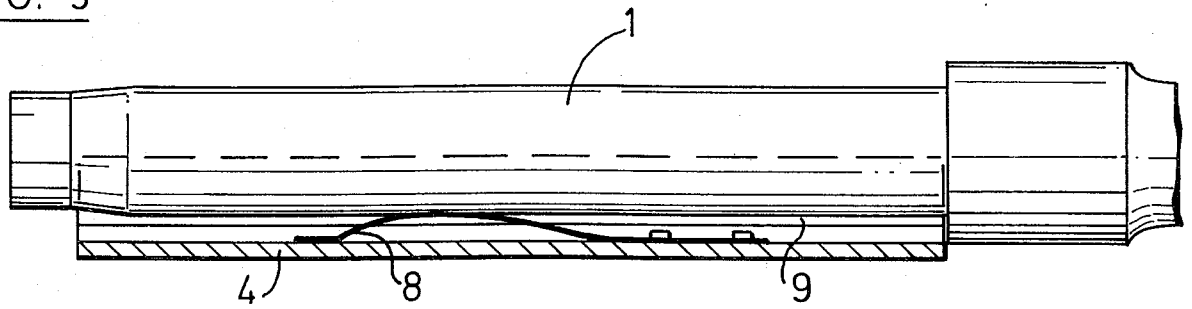
FIG. 3 is a vertical view with partial longitudinal section of the apparatus of FIG. 1, showing the detachable channel fastening means.

In the embodiment shown in FIG. 1 the apparatus comprises a metal rod 1 of circular cross-section, a first metal channel 2 coaxial to the rod and fastened to the latter, so as to be able to swivel around transversal axis 3, and a second metal channel 4 arranged in such a way as to fit in a detachable manner, longitudinally on the outer surface of rod 1. The rod contains the heating elements (not shown) supplied by an electric current from the supply network through a power cord 5 which extends through grip 6 up to the heating elements. Articulated channel 2 terminates at its extremity located on the side of grip 6 by a thrust member 7, permitting by external pressure exerted athwart the longitudinal direction of the apparatus the swivelling of channel 2 around axis 3 in such a way as to cause the former portion of channel 2 to recede from rod 1. The fastening of detachable channel 4 is ensured by an elastic member 8, formed for instance by a spring leaf as shown in FIG. 2, mounted on the inner surface of detachable channel 4. This elastic member 8, when channel 4 is slid 1 lengthwise on the outer surface of the rod proceeds to engage itself in a longitudinal groove 9 shown in FIG. 3.

With the apparatus thus designed, it is possible, under the effect of the heat released by metal components (1, 2 and 4) to effect waves in two manners: either by utilizing rod 1 for coiling the hair in it, or by utilizing the outer surface of detachable channel 4 positioned on rod 1. In the former case it is possible to make the waves more compact, or to operate with greater ease on short hair, particularly in the nape; in the latter case, wider waves can be achieved.

Figure 4:
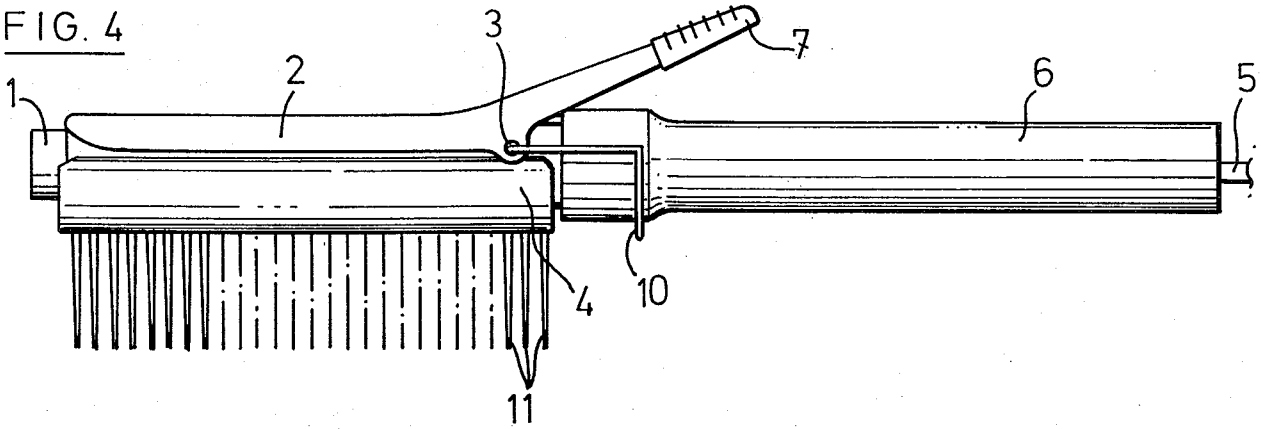
FIG. 4 illustrate a second embodiment.

As shown in FIG. 1, the apparatus is completed by an articulated U-link 10 on transversal axis 3 in such a way as to be able to swivel around that axis. In the unfolded position (shown in FIG. 1) this U-link acts as a supporting member for placing the apparatus on any kind of surface when it is hot. For putting aside the apparatus, the U-link is simply swung into the retracted position against grip 6 as shown in FIG. 4

In a second embodiment illustrated in FIG. 2, the outer surface of detachable channel 4 is fitted with a row of teeth 11 which jut out. The apparatus can then be used for combing and smoothing the hair by means of the heat released through channel 4 and teeth 11. Needless to say, it is likewise possible to provide for several rows of teeth.

What is claimed is:

1. A hairdressing iron comprising:

a. an elongated rod of a circular cross-section, b. a first elongated channel of arcuate cross-section coaxial with the rod, said first channel being adjacent said rod and having its inner curved surface facing said rod and its outer curved surface facing away from said rod, c. means pivotally connecting the first channel to the rod intermediate the ends of the rod, the axis of rotation of the pivotal means being transverse to the longitudinal axis of the rod so that the first channel can swivel from a position adjacent the rod to a position spaced from the rod, d. means providing a longitudinal groove on the outer surface of the rod on the side of the rod opposed to said first channel, e. a second channel of arcuate cross-section, said second channel being on the side of the rod opposite to said first channel and overlying the longitudinal groove, and f. means detachably securing the second channel to the rod, said means comprising an elastic member fixed to the surface of the second channel and dimensioned to be removably captive in said longitudinal groove, g. said second channel progressively increasing in thickness from both longitudinal edges towards its longitudinal center so that when the second channel is secured to the rod the rod and second channel will have a combined cross-sectional area greater than when the second channel is removed, whereby the hairdressing iron can form wide or narrow waves at the option of the user.

2. A hairdressing iron as set forth in claim 1 wherein at least one row of teeth projects away from the outer surface of said second channel.

3. A hairdressing iron as set forth in claim 1 in which a U-link is provided together with means for mounting the ends of said link on the same axis of rotation as the pivotal means connecting the first channel to the rod, said U-link being rotatable between a first position in which it lies adjacent the rod and a second position in which it extends away from the rod, said U-link in said second position acting as a support member to hold the pivotal connection means away from the supporting surface.

4. A hairdressing iron as set forth in claim 1 wherein the elastic member constitutes a leaf spring secured adjacent one end thereof to the inner surface of the second channel, the center of said leaf spring being bowed toward the rod and extending away from the inner surface of the second channel.

5. A hairdressing iron as set forth in claim 4 wherein the other end of the leaf spring is free.

* * * * *